US008210906B2

(12) United States Patent
Oishi et al.

(10) Patent No.: US 8,210,906 B2
(45) Date of Patent: Jul. 3, 2012

(54) SLICING METHOD AND METHOD FOR MANUFACTURING EPITAXIAL WAFER

(75) Inventors: Hiroshi Oishi, Nishishirakawa (JP); Daisuke Nakamata, Chikuma (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 734 days.

(21) Appl. No.: 12/310,663

(22) PCT Filed: Aug. 22, 2007

(86) PCT No.: PCT/JP2007/066231

§ 371 (c)(1),
(2), (4) Date: Mar. 3, 2009

(87) PCT Pub. No.: WO2008/035530

PCT Pub. Date: Mar. 27, 2008

(65) Prior Publication Data

US 2009/0288530 A1 Nov. 26, 2009

(30) Foreign Application Priority Data

Sep. 22, 2006 (JP) ..... 2006-257392

(51) Int. Cl.
*B24B 53/095* (2006.01)

(52) U.S. Cl. ..... 451/53; 117/11; 117/13; 117/14; 117/15; 117/37; 117/38; 117/39; 117/53; 117/54; 117/55; 117/56; 117/68; 117/69; 117/73; 117/74; 117/81; 117/82; 117/83; 117/200; 117/201; 83/651.1; 451/7

(58) Field of Classification Search ..... 117/11, 117/13–15, 37–39, 53–56, 68–69, 73–74, 117/81–83, 200–202, 206, 58; 83/651.1; 451/7, 53
See application file for complete search history.

(56) References Cited

U.S. PATENT DOCUMENTS

| | | | |
|---|---|---|---|
| 5,778,869 | A | 7/1998 | Toyama |
| 6,652,356 | B1 | 11/2003 | Ariga |
| 6,773,333 | B2 | 8/2004 | Lundt et al. |
| 2002/0174861 | A1 | 11/2002 | Lundt et al. |
| 2003/0064902 | A1 | 4/2003 | Ng et al. |

FOREIGN PATENT DOCUMENTS

| | | |
|---|---|---|
| CN | 1385288 A | 12/2002 |
| JP | A-5-185419 | 7/1993 |
| JP | A-9-262826 | 10/1997 |

(Continued)

OTHER PUBLICATIONS

Mar. 24, 2010 Office Action issued in China Patent Application No. 200780034238.4 (with partial translation).

(Continued)

*Primary Examiner* — Michael Kornakov
*Assistant Examiner* — Kenneth A Bratland, Jr.
(74) *Attorney, Agent, or Firm* — Oliff & Berridge, PLC

(57) ABSTRACT

A wafer slicing method includes winding a wire around rollers and pressing the wire against an ingot while supplying slurry to the rollers. A previously conducted experiment provides a supply temperature profile of the slurry during the slicing process and the relationship to the axial displacement of the rollers. This relationship is used to implement slurry delivery during the slicing process. The resultant wafers are bowed in a uniform direction. This slicing method provides excellent reproducibility in addition to producing wafers that are bowed in a uniform direction.

12 Claims, 15 Drawing Sheets

FOREIGN PATENT DOCUMENTS

| | | |
|---|---|---|
| JP | A-2003-1624 | 1/2003 |
| WO | WO 00/43162 | 7/2000 |

OTHER PUBLICATIONS

Feb. 25, 2010 Examination Report issued in Singapore Application No. 200901616-3.

Feb. 25, 2010 Search Report issued in Singapore Application No. 200901616-3.

Office Action issued Dec. 27, 2011 in counterpart Japanese Patent Application No. 2006-257392 (with partial English translation).

Office Action issued Dec. 9, 2011 in counterpart Chinese Patent Application No. 200780034238.4 (with partial English translation).

(B)
RELATED ART

SLICING METHOD AND METHOD FOR MANUFACTURING EPITAXIAL WAFER

TECHNICAL FIELD

The present invention relates to a slicing method for slicing, e.g., a silicon ingot or an ingot of a compound semiconductor into many wafers by using a wire saw and a method for manufacturing an epitaxial wafer by depositing an epitaxial layer on a wafer sliced out based on the slicing method.

BACKGROUND ART

In recent years, an increase in size of a wafer is demanded, and a wire saw is mainly used to slice an ingot with this increase in size.

The wire saw is a apparatus that allows a wire (a high-tensile steel wire) to travel at a high speed and presses an ingot (a work) against the wire to be sliced while applying a slurry to the wire, thereby slicing the ingot into many wafers at the same time (see Japanese Unexamined Patent Publication (Kokai) No. 262826-1997).

Here, FIG. 11 shows an outline of an example of a general wire saw.

As shown in FIG. 11, a wire saw 101 mainly includes a wire 102 that slices an ingot, grooved rollers 103 (wire guides) around which the wire 102 is wound, a mechanism 104 that gives the wire 102 a tensile force, a mechanism 105 that feeds the ingot to be sliced, and a mechanism 106 that supplies a slurry at the time of slicing.

The wire 102 is unreeled from one wire reel 107 and reaches the grooved rollers 103 through the tensile-force-giving mechanism 104 formed of a powder clutch (a constant torque motor 109), a dancer roller (a dead weight) (not shown) and so on through a traverser 108. The wire 102 is wound around this grooved rollers 103 for approximately 300 to 400 turns, and then taken up by a wire reel 107' through the other tensile-force-giving mechanism 104'.

Further, the grooved roller 103 is a roller that has a polyurethane resin press-fitted around a steel cylinder and has grooves formed at a fixed pitch on a surface thereof, and the wire 102 wound therearound can be driven in a reciprocating direction in a predetermined cycle by a driving motor 110.

It is to be noted that such an ingot-feeding mechanism 105 as shown in FIG. 12 feeds the ingot to the wire 102 wound around the grooved rollers 103 at the time of slicing the ingot. This ingot-feeding mechanism 105 includes an ingot-feeding table 111 that is used to feed the ingot, an LM guide 112, an ingot clump 113 for grasping the ingot, a slice pad plate 114, and others, and driving the ingot-feeding table 111 along the LM guide 112 under control of a computer enables feeding the ingot fixed at a end at a previously programmed feed speed.

Moreover, nozzles 115 are provided near the grooved rollers 103 and the wound wire 102, and a slurry can be supplied to the grooved rollers 103 and the wire 102 from a slurry tank 116 at the time of slicing. Additionally, a slurry chiller 117 is connected with the slurry tank 116 so that a temperature of the slurry to be supplied can be adjusted.

Such a wire saw 101 is used to apply an appropriate tensile force to the wire 102 from the wire-tensile-force-giving mechanism 104, and the ingot is sliced while causing the wire 102 to travel in the reciprocating direction by the driving motor 110.

Meanwhile, a wafer sliced out by using the above-explained wire saw 101 may be usually polished and then subjected to epitaxial growth to become a product in case of, e.g., a semiconductor wafer. In the epitaxial growth of a silicon wafer, a silicon single crystal thin film (an epitaxial layer) having a thickness of several μm is grown on a surface of a surface of a polished wafer based on, e.g., chemical vapor deposition (CVD) to improve electrical and physical properties as a wafer, and a device element is fabricated on a surface of this epitaxial layer.

Although there are many combinations of wafers and epitaxial layers, a structure where a P-type epitaxial layer having a regular resistance is grown on a P-type low-resistance wafer is general. A characteristic mark when performing this epitaxial growth lies in that a Bow (Sori) occurs in a wafer after growth as shown in FIG. 13. FIG. 13 shows an example of an epitaxial wafer 221 having an epitaxial layer 223 deposited on a wafer 222.

That is, since the P-type low-resistance wafer 222 contains a large amount of boron (B) having a smaller atomic radius than silicon as a dopant, an average interstitial distance is smaller than that of non-doped silicon. On the other hand, the P-type epitaxial layer 223 with having a regular resistance has a small dopant amount and an average interstitial distance that is relatively larger than that of the wafer. Therefore, when the epitaxial layer 223 is grown on the wafer 222, a Bow change readily occurs in the epitaxial wafer 221 in a direction along which the epitaxial layer 223 becomes convex due to bimetal deformation of both members having the different average interstitial distances.

Incidentally, in an epitaxial wafer having an N-type epitaxial layer with a small dopant amount and a regular resistance grown on an N-type low-resistance wafer containing a large amount of arsenic (As) having a larger atomic radius than that of silicon as a dopant, a Bow change occurs in a direction along which the epitaxial layer becomes concave as opposed to the example depicted in FIG. 13.

Here, FIG. 14 shows an example of a Bow change due to epitaxial growth. In FIG. 14(A), an abscissa represents a Bow value in a wafer (PW) that has been sliced out and then polished but is yet to be subjected to epitaxial growth (or a wafer after slicing), and an ordinate represents a Bow value in an epitaxial wafer (EPW) obtained by performing epitaxial growth to the PW.

Furthermore, FIG. 14(B) is a graph showing a distribution percentage of the PW and the EPW at each Bow value with an abscissa representing a Bow value.

As can be understood from FIG. 14, a correlation of a Bow in the PW sliced out by a wire saw and polished and a Bow in the epitaxial wafer obtained by performing epitaxial growth to this PW ($R^2$=0.94). Moreover, it can be revealed that an increase in Bow due to epitaxial growth is approximately +10 μm (for example, in FIG. 14(A), when a PW Bow is 0 μm, an EPW Bow is 10 μm). It is to be noted that a case where the epitaxial layer side is displaced in a convex direction is defined as a "+" direction here.

On the other hand, considering an epitaxial wafer as a product, minimizing an amount (an absolute value) of a Bow after epitaxial growth is required. It is considered that this minimization can be realized by depositing an epitaxial layer in such a manner that epitaxial growth cancels out a Bow in a wafer serving as a raw material. Therefore, to deposit the epitaxial layer to cancel out an original Bow of the sliced wafer as above, Bow directions (+/−) of the wafer must be aligned in one direction in advance before performing epitaxial growth.

However, when an ingot is sliced out based on a conventional method, Bow directions usually become irregular at respective positions of the ingot in an axial direction. Therefore, when all of the wafers obtained by slicing are measured in a process before polishing and they have Bows in a direction opposite to a desired direction, the wafers must be turned upside down one by one to be put into, e.g., a polishing apparatus in a reversed direction, which is troublesome.

DISCLOSURE OF INVENTION

Therefore, in view of the above-explained problem, it is an object of the present invention to provide a slicing method that can easily perform slicing with excellent reproducibility with Sori of all wafers being trued up to one direction when slicing an ingot by using a wire saw. Additionally, another object is providing an epitaxial wafer manufacturing method that does not require Bow measurement and a reversing operation of sliced wafers sliced out like a conventional example.

To achieve these objects, the present invention provides a slicing method comprising winding a wire around a plurality of grooved rollers and pressing the wire against an ingot to be sliced into wafers while supplying a slurry for slicing to the grooved rollers and causing the wire to travel, wherein a test of slicing the ingot while supplying the slurry for slicing to the grooved rollers and controlling a supply temperature thereof is previously conducted to examine a relationship between an axial displacement of the grooved rollers and a supply temperature of the slurry for slicing, a supply temperature profile of the slurry for slicing is set based on the relationship between an axial displacement of the grooved rollers and a supply temperature of the slurry for slicing, and the slurry for slicing is supplied based on the supply temperature profile to slice the ingot while controlling an axial displacement of the grooved rollers and to uniform Sori of all wafers to be sliced out in one direction.

As explained above, according to the slicing method of the present invention, the test of slicing the ingot is first conducted while supplying the slurry for slicing to the grooved rollers and controlling a supply temperature of the slurry for slicing, thereby examining a relationship between an axial displacement of the grooved rollers and the supply temperature of the slurry for slicing. Carrying out such an examination in advance enables previously obtaining a relationship between the axial displacement of the grooved rollers inherent to each wire saw to be utilized and the supply temperature of the slurry for slicing.

Then, based on the relationship between the axial displacement of the grooved rollers and the supply temperature of the slurry for slicing obtained as explained above, a supply temperature profile of the slurry for slicing enabling Sori of wafers to be sliced out to be aligned in one direction is set. Further, when the slurry for slicing is supplied based on this profile, the ingot is sliced while controlling the axial displacement of the grooved rollers in the wire saw to be utilized, and Sori of all wafers to be sliced out is uniformed in one direction.

Since the supply temperature profile of the slurry for slicing is set based on the above relationship inherent to each wire saw and the slurry for slicing is actually supplied to perform slicing, Sori of all the wafers to be sliced out can be easily uniformed in one direction with excellent reproducibility. Furthermore, since Sori of all the wafers can be uniformed in one direction, it is possible to eliminate an operation of measuring a shape of each wafer in advance and turning over each wafer to align directions of Bows so that epitaxial growth can be performed on a desired surface side before depositing an epitaxial layer as will be explained later.

At this time, it is possible that the supply temperature profile of the slurry for slicing is adjusted to adjust amounts of Sori of all the wafers to be sliced out.

As explained above, since the relationship between the axial displacement of the grooved rollers and the supply temperature of the slurry for slicing is examined in advance, adjusting the supply temperature profile of the slurry for slicing set based on this relationship enables adjusting the axial displacement of the grooved rollers and also adjusting amounts of Sori of all the wafers to be sliced out.

Moreover, it is possible that the supply temperature profile of the slurry for slicing is set as at least a profile that the supply temperature is gradually increased after a slicing depth of the ingot reaches ½ of a diameter.

Alternatively, it is possible that the supply temperature profile of the slurry for slicing is set as a profile that the supply temperature is gradually increased from start of slicing the ingot.

As explained above, Sori of all wafers to be sliced out can be further readily uniformed in one direction based on whether the supply temperature profile of the slurry for slicing is set at least as the profile that the supply temperature is gradually increased when the slicing depth of the ingot reaches ½ of the diameter or whether the supply temperature profile of the slurry for slicing is set as the profile that the supply temperature is gradually increased after start of slicing the ingot.

Additionally, the present invention provides a method for manufacturing an epitaxial wafer, wherein wafers having Sori uniformed in one direction are sliced out by the slicing method described above, and an epitaxial layer is deposited on the wafers having Sori uniformed in one direction.

A explained above, if wafers having Sori aligned in one direction are sliced out based on the slicing method and the epitaxial layer is deposited on each wafer having the Sori aligned in one direction, it is possible to eliminate a conventionally required operation of measuring directions of Bows of wafers sliced out from an ingot in advance before performing epitaxial growth and turning over each wafer to align directions of Bows to one direction when the directions are not aligned, thereby greatly a work efficiency can be improved.

According to the slicing method of the present invention, slicing can be easily performed with excellent reproducibility while uniforming Sori of all wafers in one direction. Furthermore, since all wafers can be sliced out with Sori thereof while being aligned in one direction, the operation of measuring Bows and turning over the wafers sliced out from the ingot does not have to be performed, thus a work efficiency can be considerably improved.

BRIEF DESCRIPTION OF DRAWINGS

FIG. 9 are graphs each showing a relationship between a work slicing depth and an axial displacement of the grooved rollers, wherein FIG. 9(A) shows Example and FIG. 9(B) shows Comparative Example;

FIG. 10 are graphs each showing a measurement result of Bows of all sliced wafers, wherein FIG. 10(A) shows Example and FIG. 10(B) shows Comparative Example;

BEST MODE(S) FOR CARRYING OUT THE INVENTION

An embodiment according to the present invention will now be explained hereinafter, but the present invention is not restricted thereto.

Figure 13:
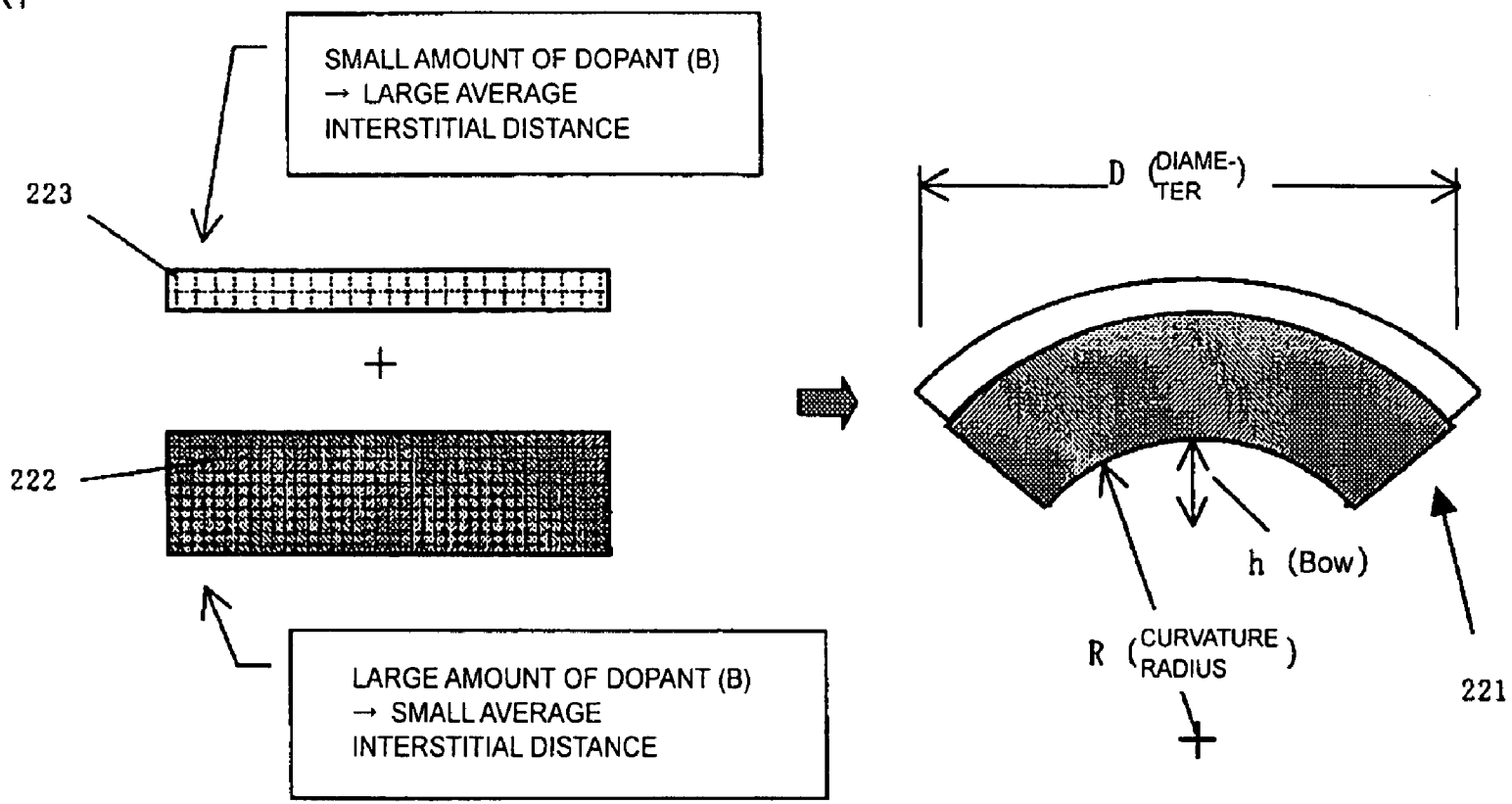
FIG.13 RELATED ART
FIG. 13 is an explanatory view for explaining a factor of a change in Bow based on epitaxial growth.

As explained above, when a wafer is subjected to epitaxial growth, an epitaxial wafer Sori as shown in FIG. 13. Thus, when directions of Bows are aligned in one direction in advance before subjecting the wafer to epitaxial growth and an epitaxial layer is deposited to cancel out a Bow of a wafer as a raw material, an amount of a Bow of a completed epitaxial wafer can be minimized, which is preferable as a product.

Figure 14:
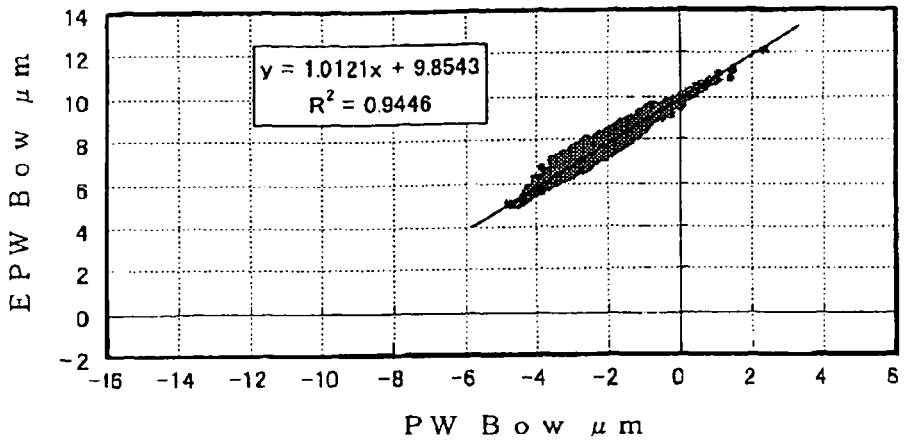
FIG. 14 RELATED ART
FIG. 14(A) is a graph showing a correlation of a Bow value between an epitaxial wafer (EPW) and a wafer (PW)
FIG. 14(B) is a graph showing a distribution of a percentage of each Bow value in the epitaxial wafer (EPW) and the wafer (PW)
Figure 14:
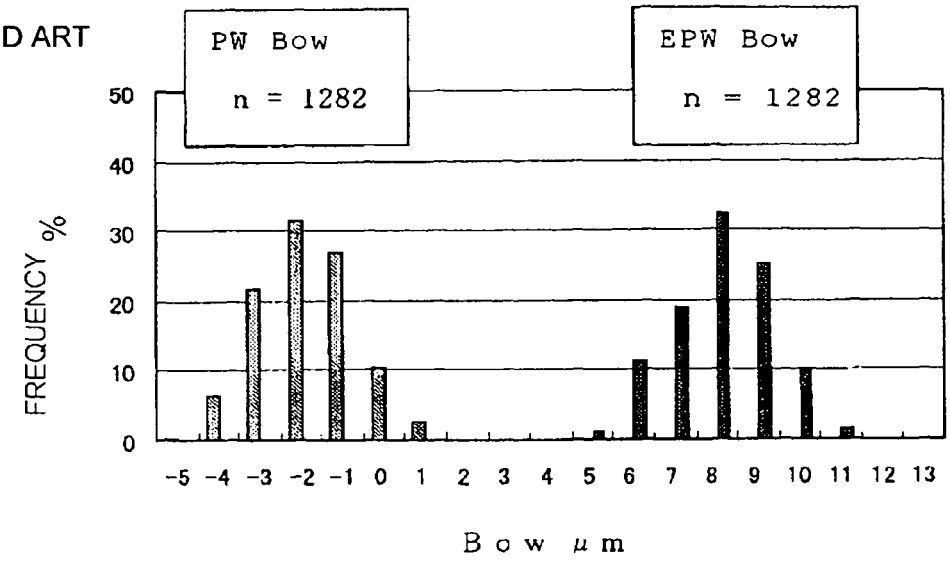
FIG. 14 RELATED ART

For example, in FIG. 14(A), when a Bow of the wafer is generated at the time of slicing in such a manner that an average value of Bows becomes approximately −10 μm, it can be expected that an absolute value of Bows of the epitaxial wafer is minimized (however, in practice, reducing waviness at the time of slicing or reducing nano-topography based on double-disc grinding becomes difficult when an absolute value of Bows of the wafer is very large, and hence it can be considered that an average value of approximately −5 μm is appropriate as an actual target value).

However, in the wafers serving as a raw material, i.e., wafers sliced out by using a wire saw, directions of Bows of the sliced-out wafers are not aligned in one direction. Therefore, there is required a process of measuring shapes of all wafers to align directions of Sori in one direction before performing epitaxial growth.

Figure 15:
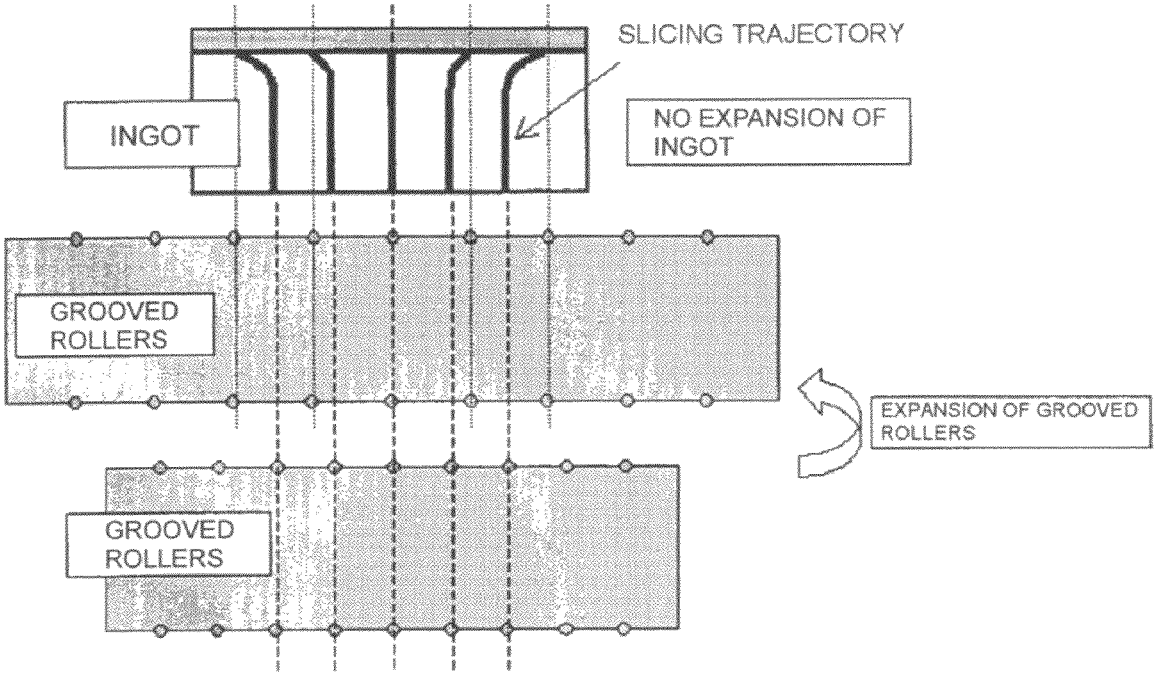
FIG. 15 is an explanatory view showing an example of expansion of the grooved rollers and slicing trajectories at the time of slicing the ingot.

Thus, the present inventors keenly studied about a relationship between the wire saw and sliced-out wafers. In the first place, as a factor of occurrence of Bows having different directions in the sliced-out wafers, grooved rollers having a wire wound therearound is thermally expanded and expanded (or contracted) in an axial direction thereof when a temperature of a slurry for slicing to be supplied is increased. For instance, there is an example depicted in FIG. 15. FIG. 15 shows an example of a change in axial length of the grooved rollers and a change in slicing trajectories of an ingot when the slurry for slicing is supplied to perform slicing with a standard supply temperature profile in a conventional slicing method that uses a general wire saw, sets a supply temperature of the slurry for slicing to 23° C. of start of slicing, then reduces the temperature to 22° C. at a middle stage of slicing, and increases the temperature in the time close to end of slicing so that the temperature reaches 24° C. at end of slicing. As shown in FIG. 15, the slicing trajectories differ at respective position in the axial direction of the ingot, and hence directions of Bows of all sliced wafers are not uniformed.

Furthermore, since expansion/contraction of the grooved rollers in the axial direction is inherent to a structure of the wire saw, an axial displacement profile during slicing varies depending on each wire saw to be used, and slicing trajectories differ from each other.

As explained above, producing Bows of all the wafers in one direction at the time of slicing is not easy.

On the other hand, there is a method that changes an axial length of the grooved rollers during slicing to suppress a Bow value and performs slicing to obtain wafers in the conventional technology (see, e.g., Japanese Unexamined Patent Publication (Kokai) No. 185419-1993). For example, this is a method that calculates measured data by using a computer while measuring an axial length of the grooved rollers to control a temperature of a coolant circulating in a bearing of the grooved rollers or control a supply temperature of a slurry to slice an ingot. However, there are problems that controlling detection of an axial length during slicing and change in this length is difficult, and that properties of following a change of the grooved rollers in the axial direction are poor, and therefore the method is not practical.

Thus, the present inventors conceived a slicing method that first performs a preliminary test to examine a relationship between a supply temperature of the slurry for slicing and an axial displacement of the grooved rollers, sets a supply temperature profile of the slurry for slicing uniforming Sori of wafers to be sliced out in one direction from this relationship, and supplies the slurry for slicing based on this profile to slice an ingot, thereby uniforming Sori of all wafers to be obtained by slicing in one direction. According to such a slicing method, since Sori of all sliced-out wafers are aligned in one direction, when subjecting the sliced-out wafers to epitaxial growth, a process of measuring shapes of the wafers and uniforming Sori in one direction, which is carried out before epitaxial growth in the conventional example can be omitted. And thereby a work efficiency is improved. Moreover, since a preliminary test is performed to examine characteristics of the grooved rollers in the wire saw to be used and the slurry for slicing is supplied to perform slicing in accordance with a supply temperature profile of the slurry for slicing set from a result of this examination, slicing is performed while uniforming Sori of the wafers easily and assuredly in one direction with high reproducibility. Even if the wire saw (the grooved rollers) to be used varies, the preliminary test is conducted, and hence it is possible to cope with the change each time.

A slicing method using a wire saw according to the present invention will now be explained in detail hereinafter with reference to the drawings, but the present invention is not restricted thereto.

Figure 1:
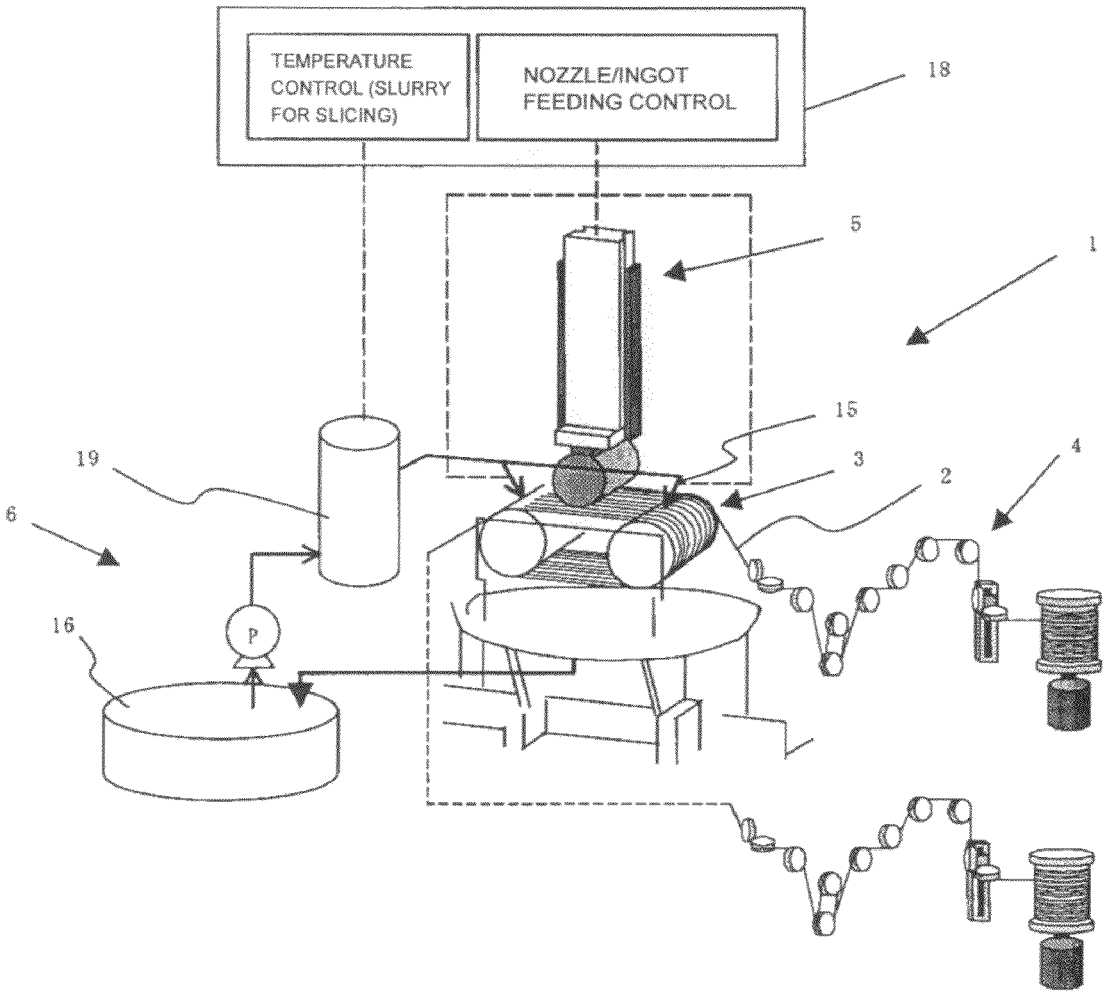
FIG. 1 is a schematic view showing an example of a wire saw that can be used for a slicing method according to the present invention.

FIG. 1 shows an example of a wire saw that can be used for the slicing method according to the present invention.

As shown in FIG. 1, a wire saw 1 mainly includes a wire 2 to slice an ingot, grooved rollers 3, wire-tensile-force-giving mechanisms 4, and an ingot-feeding mechanism 5, and a slurry-supplying mechanism 6.

Here, the slurry-supplying mechanism 6 will be first explained. As this slurry-supplying mechanism 6, nozzles 15 that supply a slurry for slicing to the grooved rollers 3 (the wire 2) is arranged. Further, a supply temperature of the slurry for slicing supplied from these nozzles 15 can be controlled. Specifically, for example, as shown in FIG. 1, the supply temperature of the slurry for slicing can be controlled by connecting a slurry tank 16 to the nozzles 15 through a heat exchanger 19 controlled by a computer 18.

Furthermore, a type of the slurry is not restricted in particular, and the same type as that in the conventional example can be used. For example, a slurry obtained by dispersing GC (silicon carbide) abrasive grains in a liquid can be used.

Moreover, the nozzles 15 that supply the slurry for slicing and the ingot-feeding mechanism 5 are connected with the computer 18, and a predetermined amount of the slurry for slicing controlled in temperature can be automatically sprayed from the nozzles 15 to the grooved rollers 3 (the wire 2) at a predetermined timing with respect to a predetermined ingot-feeding amount, i.e., a predetermined ingot-slicing amount by using a preset program.

Although the ingot-feeding amount, the slurry-spraying amount and timing, and a supply temperature of the slurry can be controlled in a desired manner by the computer 18, controlling means is not restricted thereto in particular.

Figure 11:
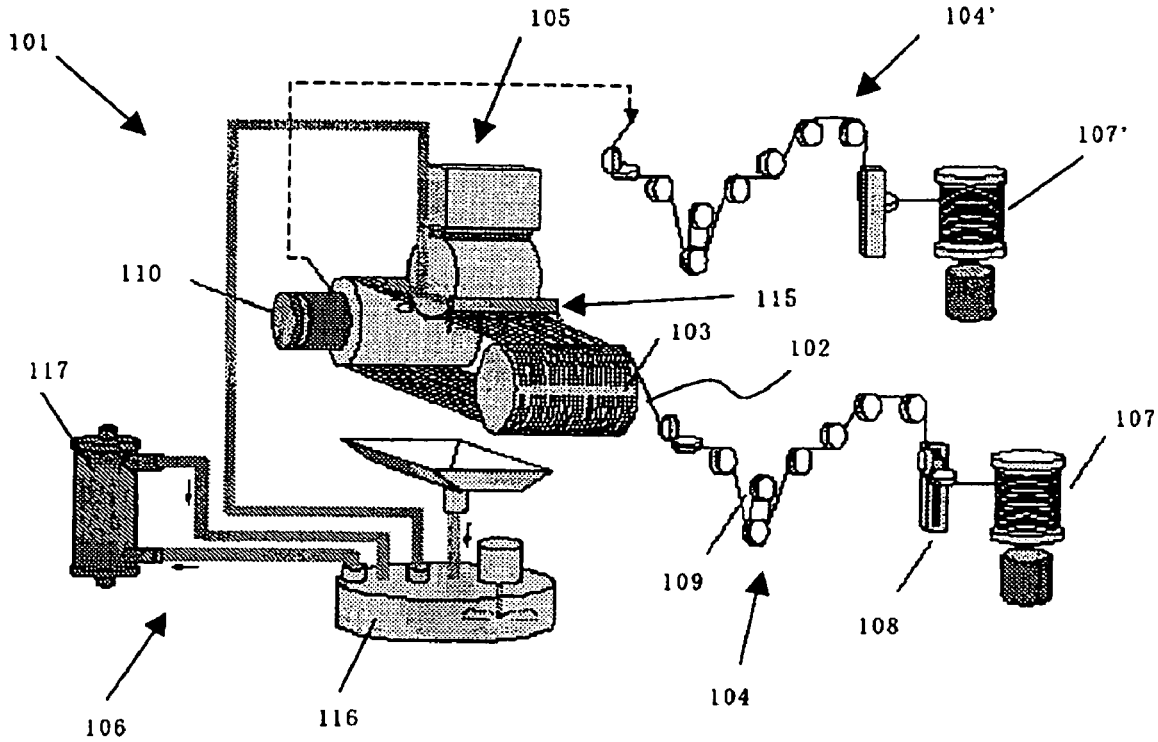
FIG.11 RELATED ART
FIG. 11 is a schematic view showing an example of a wire saw used in a conventional slicing method.
Figure 12:
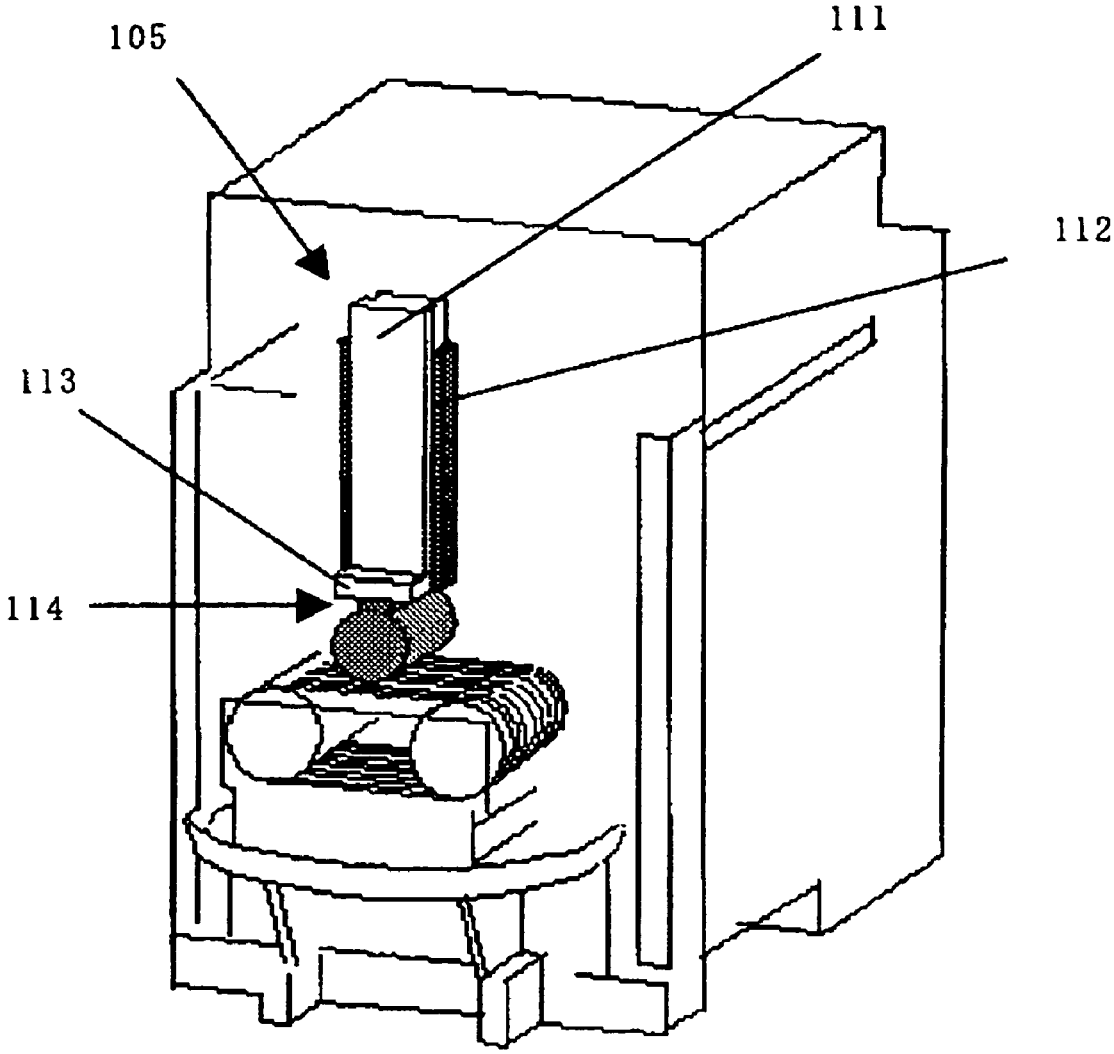
FIG.12 RELATED ART
FIG. 12 is a schematic view showing an example of an ingot-feeding mechanism.

Furthermore, the wire 2, the grooved rollers 3, the wire-tensile-force-giving mechanisms 4, and the ingot-feeding mechanism 5 except the slurry-supplying mechanism 6 can be the same as those in the wire saw 101 used in the conventional slicing method depicted in FIG. 11.

A type and a thickness of the wire 2, a groove pitch of the grooved roller 3, a structure in any other mechanism, and others are not restricted in particular, and they can be determined each time so that desired slicing conditions can be obtained in accordance with the conventional method.

For example, the wire 2 can be formed of, e.g., a special piano wire having a width of approximately 0.13 mm to 0.18 mm, and the grooved roller 3 having a groove pitch of (a desired wafer thickness+a slicing removal) can be adopted.

Figure 2:
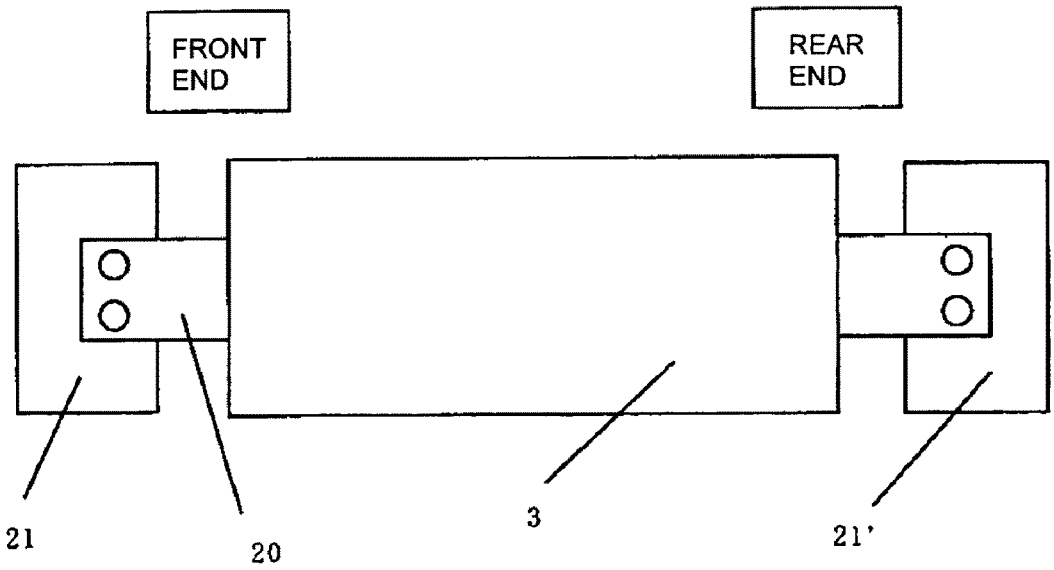
FIG. 2 is a schematic plane view showing an example of a structure of grooved rollers.

It is to be noted that the grooved rollers 3 will be further explained in detail. As an example of the conventionally utilized grooved rollers 3, there is such a grooved rollers as shown in FIG. 2. Although bearings 21 and 21' that support a shaft 20 of the grooved rollers are arranged at both ends of the grooved rollers 3, the bearing 21 is of, e.g., a radial type while considering a change of the grooved rollers 3 in the axial direction during slicing so that the grooved rollers 3 can expand in the axial direction on a side of this radial type bearing 21 and, on the other hand, the bearing 21' is of a thrust type so that the grooved rollers 3 are hard to expand on a side of this thrust type bearing 21'. Usually, the grooved rollers 3 has such a structure, and both sides thereof are not fixed, but one of them can cope with a change in axial length of the grooved rollers 3 to prevent an excessive load from being applied to the apparatus when this change in axial length occurs.

Therefore, in this wire saw apparatus 1, when the grooved rollers 3 expand in the axial direction, expansion mainly advances on the side of the radial type bearing 21 (which is a front side of the grooved rollers 3).

It is to be noted that, in the slicing method according to the present invention, the grooved rollers 3 are not restricted to the above-explained type in the wire saw 1 to be used.

Figure 3:
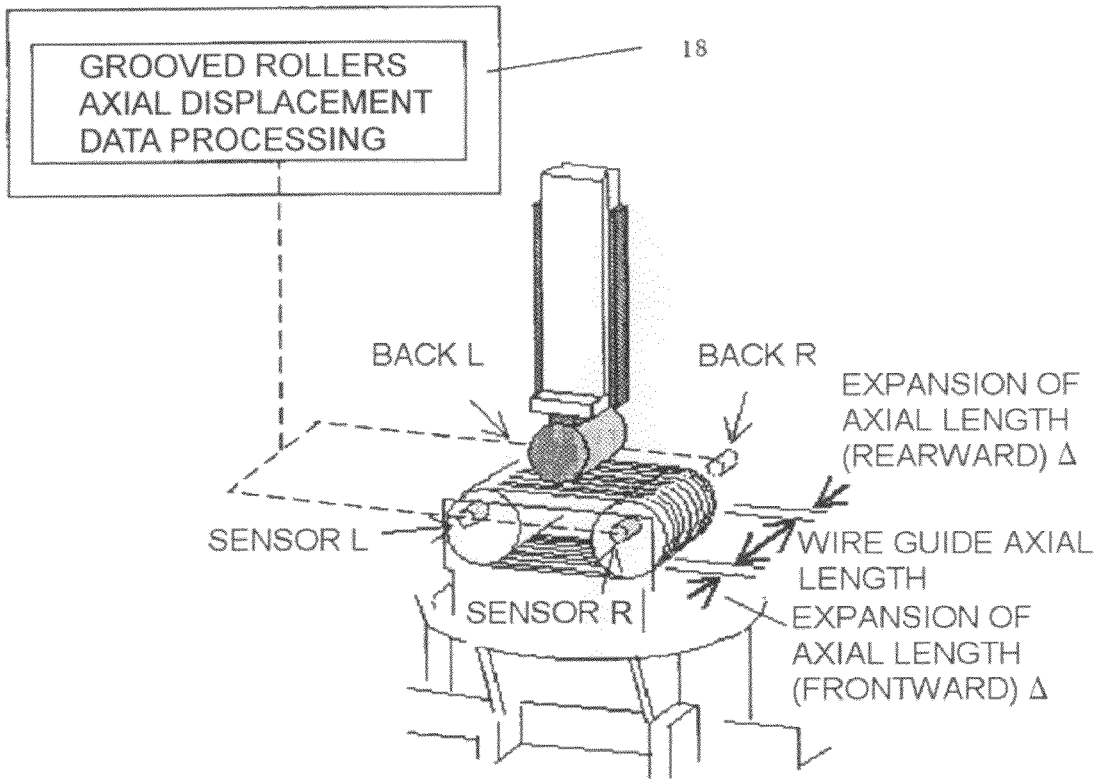
FIG. 3 is an explanatory view for explaining a method for measuring an expansion/contraction amount of the grooved rollers.

Additionally, as shown in FIG. 3, an eddy current sensors are arranged in close proximity to the axial direction of the grooved rollers. This enables measuring an axial displacement of the grooved rollers 3 in the preliminary test. Although this measurement of an axial displacement of the grooved rollers 3 is not restricted to the above-explained means, using the eddy current sensors enable highly accurate measurement in a non-contact manner, which is preferable.

Each sensor is connected with the computer 18, and data obtained from measurement can be subjected to data processing by the computer 18.

A procedure for carrying out the slicing method according to the present invention by using such a wire saw 1 will now be explained.

First, a preliminary test is conducted to examine a relationship between an axial displacement of the grooved rollers 3 in this wire saw 1 to be utilized and a supply temperature of the slurry for slicing that is supplied to this grooved rollers 3 during slicing.

The same ingot as an ingot that is actually sliced (which is determined as a main-slicing process) after this preliminary test is prepared, and the ingot is sliced while controlling and changing a supply temperature of the slurry for slicing. At the same time, an axial displacement of the grooved rollers 3 is also measured by using the eddy current sensor arranged in close proximity to the axial direction of the grooved rollers 3.

A supply temperature profile of the slurry for slicing at this time is not restricted in particular, and a profile enabling assuredly measuring an axial displacement of the grooved rollers 3 associated with each supply temperature can suffice. For example, when supply is started at the same temperature as that of the ingot at the beginning of slicing and a supply temperature is gradually increased at a speed enabling following a change in supply temperature of the slurry for slicing, an axial displacement of the grooved rollers 3 at each supply temperature can be measured.

It is to be noted that the relationship between an axial displacement of the grooved rollers 3 and a supply temperature of the slurry for slicing is examined in this preliminary test, and adopting other conditions, e.g., a tensile force applied to the wire in this preliminary test equal to conditions in the main-slicing process which is performed later is preferable. When such conditions are adopted, the relationship between an axial displacement of the grooved rollers 3 and a supply temperature of the slurry for slicing obtained in the preliminary test can be more accurately applied to the main-slicing process.

Figure 4:
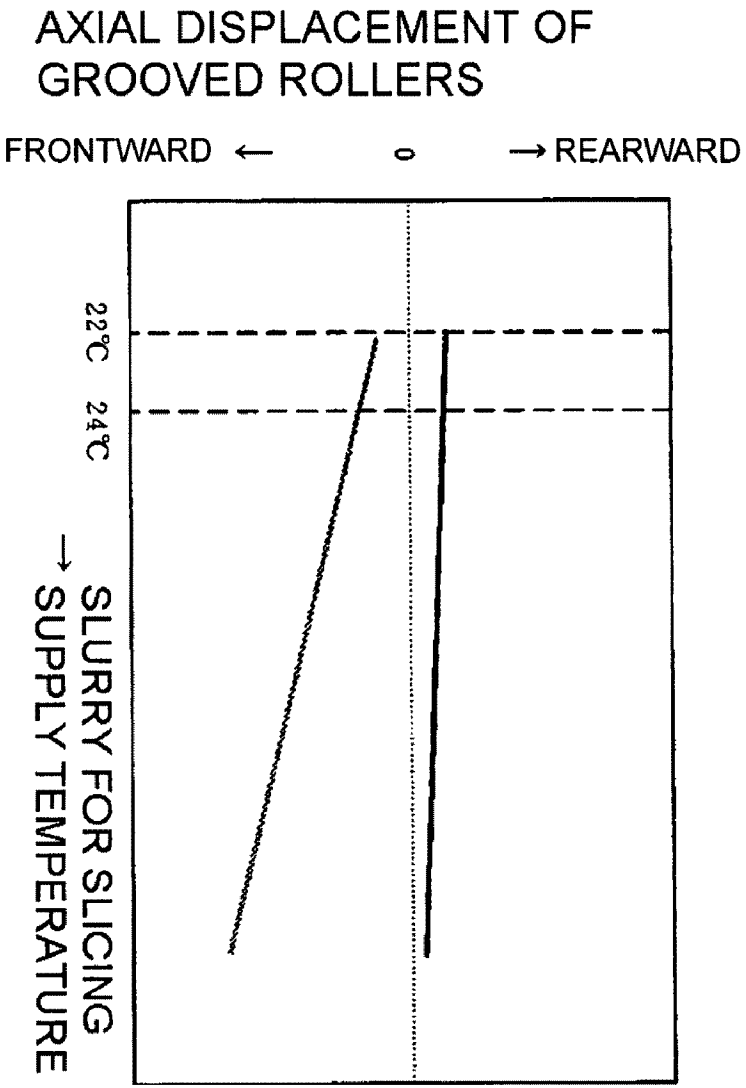
FIG. 4 is a graph showing an example of a relationship between an axial displacement of the grooved rollers 3 and a supply temperature of a slurry for slicing.

Furthermore, such a relationship between an axial displacement of the grooved rollers 3 and a supply temperature of the slurry for slicing as depicted in FIG. 4 can be obtained as explained above.

It is to be noted that an upper line in FIG. 4 represents an amount that the grooved rollers 3 expands rearward (i.e., the side of the thrust type bearing 21') and a lower line represents an amount that the same expands frontward (the side of the radial type bearing 21).

As explained above, it can be understood that the grooved rollers 3 of this wire saw 1 having a structure where the thrust type bearing 21' and radial type bearing 21 support the shaft 20 of the grooved rollers do not expand much toward the side of thrust type bearing 21' as the rear side but expands toward the side of the radial type bearing 21 as the front side as a consequence even though a temperature of the slurry for slicing is increased.

A supply temperature profile of the slurry for slicing in the main-slicing process that is subsequently performed is set based on the thus obtained relationship.

When setting this supply temperature profile, the profile is set so as to form slicing trajectories enabling uniforming Sori of all wafers to be sliced in one direction. When setting this profile, using, e.g., the computer 18 enables easy and accurate setting, which is preferable. The data obtained from the preliminary test is processed by the computer 18, thereby an appropriate supply temperature profile of the slurry for slicing can be obtained so that predetermined desirable slicing trajectories can be obtained, namely, the grooved rollers can be changed in the axial direction in a desired manner.

The above supply temperature profile of the slurry for slicing will now be more specifically explained. It is to be noted that the wire saw to be utilized will be explained as the wire saw 1 having such a structure as depicted in FIGS. 1 to 3 here. That is, this is an apparatus that can obtain such a relationship between an axial displacement of the grooved rollers 3 and a supply temperature of the slurry for slicing as shown in FIG. 4. However, the present invention is not of course restricted to use of such a wire saw. The supply temperature profile of the slurry for slicing can be appropriately adjusted in accordance with characteristics of each wire saw.

First, a supply temperature of the slurry for slicing is changed only in the range of approximately 22 to 24° C. in the conventional example, and both a rearward expansion amount and a frontward expansion amount of the grooved rollers 3 rarely differ at the moment close to start of slicing and the moment close to end of slicing in the entire slicing process, namely, a direction of each Bow is apt to vary with a small change when the above-explained range is adopted and the relationship between an axial displacement of the grooved rollers 3 and a supply temperature of the slurry for slicing is represented by such a graph as depicted in FIG. 4. It can be considered that the similar situation is apt to occur when each Bow value is suppressed to be small. Therefore, slicing trajectories are hardly uniformed in one direction, and a direction of a Bow of each wafer to be sliced out of course varies depending on a position of the ingot in the axial direction (a direction of a Bow may be highly possibly reversed at each of both ends of the ingot).

Figure 5:
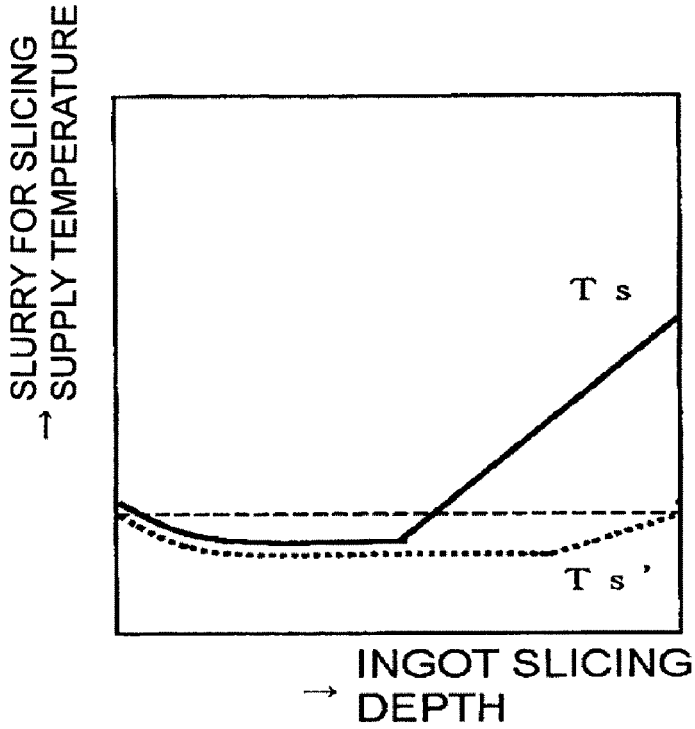
FIG. 5(A) is a graph showing an example of a supply temperature profile of the slurry for slicing set based on a result of a preliminary test.
FIG. 5(B) is a graph showing another example of the supply temperature profile of the slurry for slicing set based on a result of a preliminary test.
Figure 5:
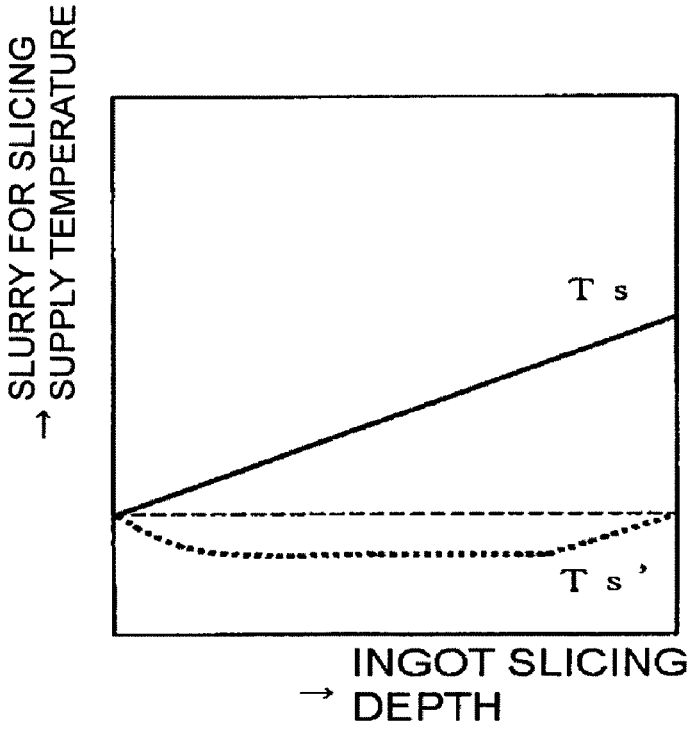

Thus, it is good enough to increase a supply temperature by setting such a profile as depicted in, e.g., FIG. 5(A) and control an axial displacement of the grooved rollers 3 during slicing by intentionally increasing a displacement amount of the grooved rollers in the axial direction (see FIG. 4) so as to provide slicing trajectories uniforming Sori of all wafers to be sliced out in one direction. A supply temperature profile Ts shown in FIG. 5(A) is a profile that a supply temperature is gradually increased after a slicing depth of the ingot reaches ½ or more of a diameter. It is to be noted that a standard supply temperature profile Ts' of the slurry for slicing in the conventional example is shown for the sake of comparison.

When such a profile Ts is used, since a supply temperature of the slurry for slicing is gradually increased after the moment that the ingot is sliced half or more until slicing is finished, a front end portion of the grooved rollers 3 expand frontward while a rear end portion of the same also slightly expand frontward when the slicing depth of the ingot reaches ½ or more of the diameter as can be understood from FIG. 4, and hence a slicing trajectory at each of both ends of the ingot can have a Sori shape that is convex rearward of the ingot (in regard to slicing trajectories at the ingot rear end portion, trajectories are reversed in the time close to start of slicing and the time close to end of slicing, and a position near the center of the ingot is a halfway mark of the entire Sori). Therefore, slicing can be performed while uniforming Sori of all the wafers to be sliced out in one direction.

Figure 6:
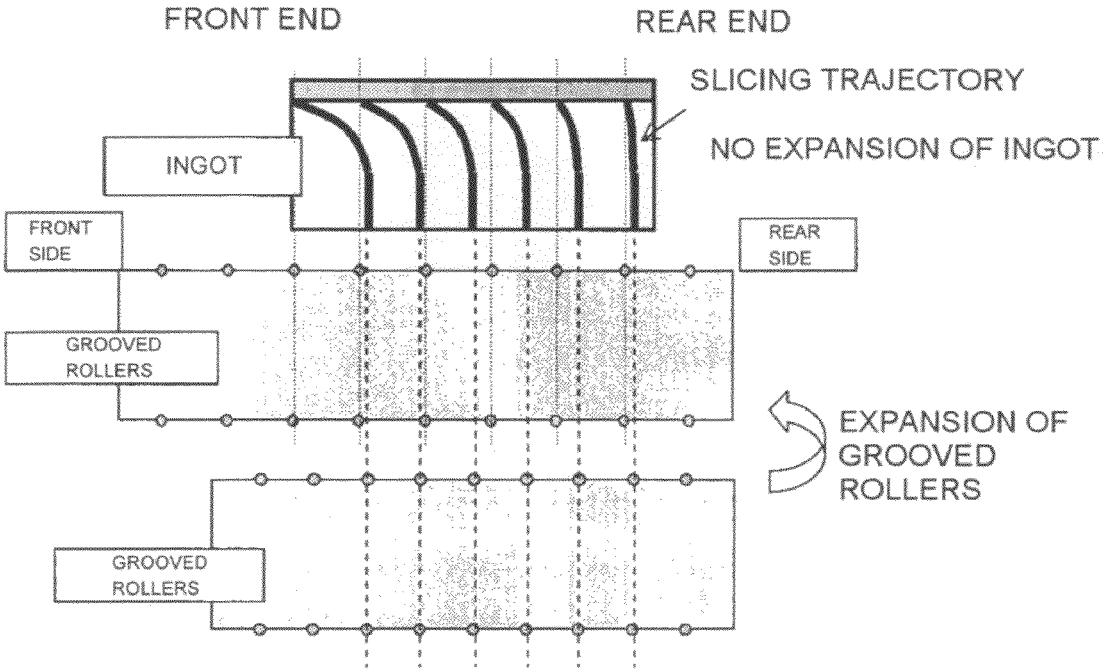
FIG. 6 is an explanatory view showing a process of performing slicing in such a manner that directions of Sori of wafers are uniformed in one direction.

FIG. 6 shows an example of a process that slicing is performed while uniforming Sori of all the wafers to be sliced out in one direction. As shown in FIG. 6, it can be understood that Sori of slicing trajectories are aligned since the grooved rollers largely expands frontward. It is to be noted that, when the rear end portion of the grooved rollers 3 expands rearward in the time close to start of slicing and then it slightly expands frontward during slicing as explained above, Sori directions of slicing trajectories at the rear end portion can coincide with Sori directions of slicing trajectories at the ingot front end portion.

Moreover, for example, when a profile that a supply temperature is gradually increased from start of slicing the ingot such as shown in FIG. 5(B) is adopted and slicing is performed while supplying the slurry for slicing based on this profile and controlling a displacement of the grooved rollers 3, Sori of all the wafers can be uniformed in one direction.

Additionally, when the profile increasing a supply temperature of the slurry for slicing from an earlier stage in slicing is used in this manner, amounts of Sori of all the wafers to be sliced out can be significantly adjusted in this case. This is also apparent from FIGS. 4 and 6. That is, since an axial displacement amount of the grooved rollers 3 is increased as a supply temperature of the slurry for slicing rises, when the supply temperature is gradually increased from start of slicing, each slicing trajectory at each position of the ingot largely curves, and amounts of Sori of all the wafers to be sliced out are also increased. It is good enough to appropriately carry out adjustment so as to obtain Sori having desired amounts.

It is to be noted that the two supply temperature profiles of the slurry for slicing depicted in FIG. 5(A) and FIG. 5(B) have been taken as examples and explained, the present invention is not of course restricted to these profiles.

Characteristics of each wire saw (each grooved rollers) are examined by conducting the preliminary test according to the wire saw to be utilized, a supply temperature profile of the slurry for slicing is appropriately set based on a relationship between an axial displacement of the grooved rollers and a supply temperature of the slurry for slicing obtained by this examination so as to uniform Sori of all wafers in one direction in a desired manner, and the slurry for slicing is supplied based on this profile to slice the ingot, thereby Sori of all wafers can be uniformed in one direction.

Therefore, it is possible to cope with a situation every time even though the wire saw changes, just performing slicing based on the supply temperature profile of the slurry for slicing obtained through the preliminary test can suffice, and hence Sori of all wafers can be readily uniformed in one direction with high reproducibility.

Further, a method for manufacturing an epitaxial wafer according to the present invention is a manufacturing method of slicing out wafers having Sori uniformed in one direction based on the slicing method of the present invention and depositing an epitaxial layer on each of the wafers having Sori uniformed in one direction.

As explained above, uniforming Sori of all wafers to be sliced out from an ingot in one direction is not easy in the conventional technology, and hence shapes of wafers whose Sori directions differ depending on each position in the ingot in the axial direction must be measured one by one to confirm directions of Sori before depositing the epitaxial layer (before polishing each wafer, for example), an operation that Sori directions of all wafers are uniformed in one direction by turning over each wafer having an opposite direction must be performed. Such an operation is very complicated and requires a cost and labor.

However, in the method for manufacturing an epitaxial wafer according to the present invention, since Sori of all wafers are already uniformed in one direction when these wafers are sliced out from an ingot, the wafers having Sori uniformed in one direction can be subjected to epitaxial growth without performing the above-explained complicated operation, which is very simple, thus a work efficiency can be considerably improved.

It is to be noted that wafers having Sori uniformed in one direction can be of course subjected to a process, e.g., polishing in advance before the epitaxial growth.

Although the present invention will now be explained in more detail based on examples, but the present invention is not restricted thereto.

EXAMPLE

The slicing method according to the present invention was carried out by using the wire saw depicted in FIG. 1. As a preliminary test, the same silicon ingot as a silicon ingot having a diameter of 300 mm and an axial length of 180 mm to be used in a main-slicing process was sliced into wafers while supplying a slurry for slicing and controlling a supply temperature thereof.

It is to be noted that a wire having a width of 160 μm was used, and a tensile force of 2.5 kgf was applied to cause the wire to travel in a reciprocating direction at an average speed of 500 m/min in a cycle of 60 s/c, thereby performing slicing. It is to be noted that a material obtained by mixing GC#1500 with a coolant at a weight rate of 1:1 was used as a slurry. These conditions are the same as slicing conditions in a main-slicing process that is carried out later.

Figure 7:
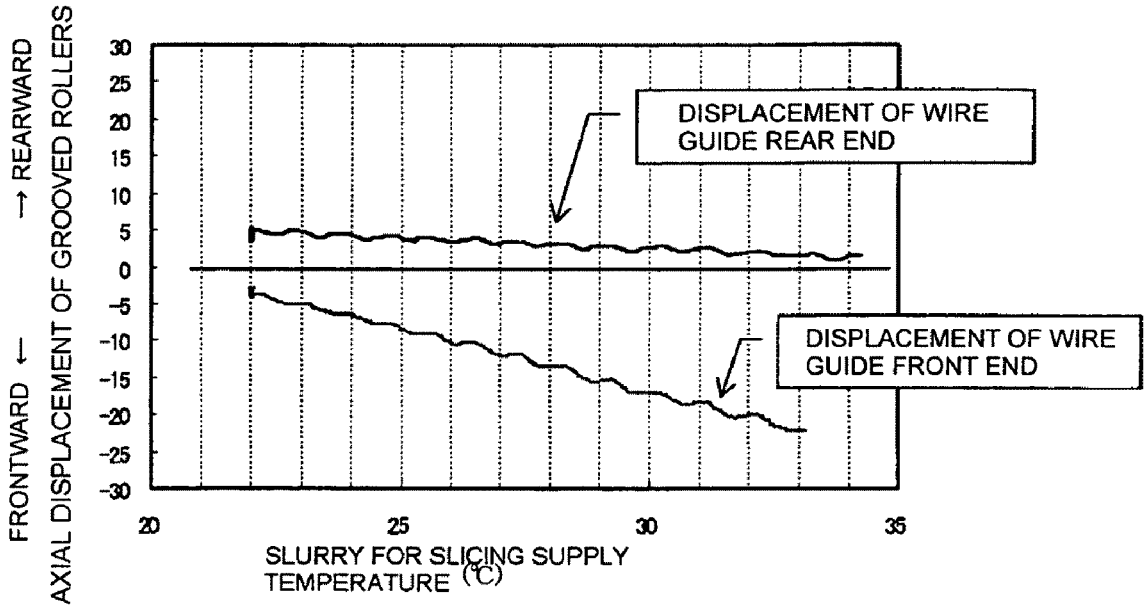
FIG. 7 is a graph showing a relationship between an axial displacement of a grooved rollers and a supply temperature of a slurry for slicing obtained in a preliminary test in Example.

Further, at this time, a supply temperature of a slurry for slicing was increased from 22° C. to 35° C., and expansion of a grooved rollers 3 was measured by eddy current sensors, thereby obtaining a relationship between an axial displacement of the grooved rollers and a supply temperature of the slurry for slicing. FIG. 7 shows this relationship. An upper line in FIG. 7 represents a rearward expansion amount of the grooved rollers and a lower line represents a frontward expansion amount of the same in accordance with each supply temperature of the slurry for slicing. These lines form the same pattern as the relationship depicted in FIG. 4.

Figure 8:
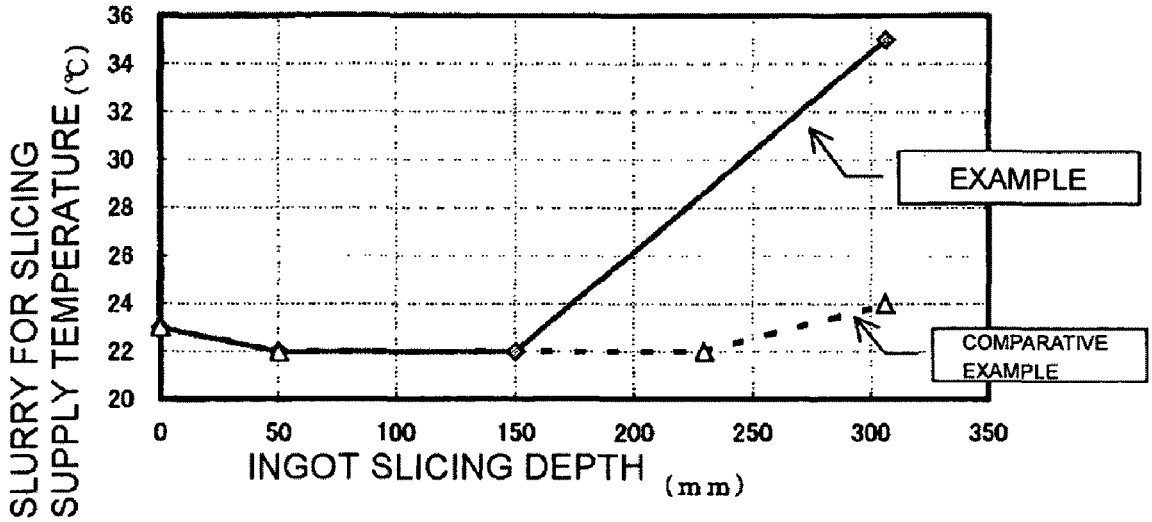
FIG. 8 is a graph showing supply temperature profiles of slurries for slicing in Example and Comparative Example.

Then, a supply temperature profile of the slurry for slicing depicted in FIG. 8 was set based on this obtained relationship in such a manner that Sori directions of slicing trajectories in the ingot became convex rearward at each position in the ingot along the axial direction and Sori directions of wafers to be sliced out can be uniformed in this direction.

The silicon ingot was sliced based on this profile as a main-slicing process to obtain 170 sliced wafers. The slicing conditions are the same as those of the preliminary test as explained above.

Figure 9:
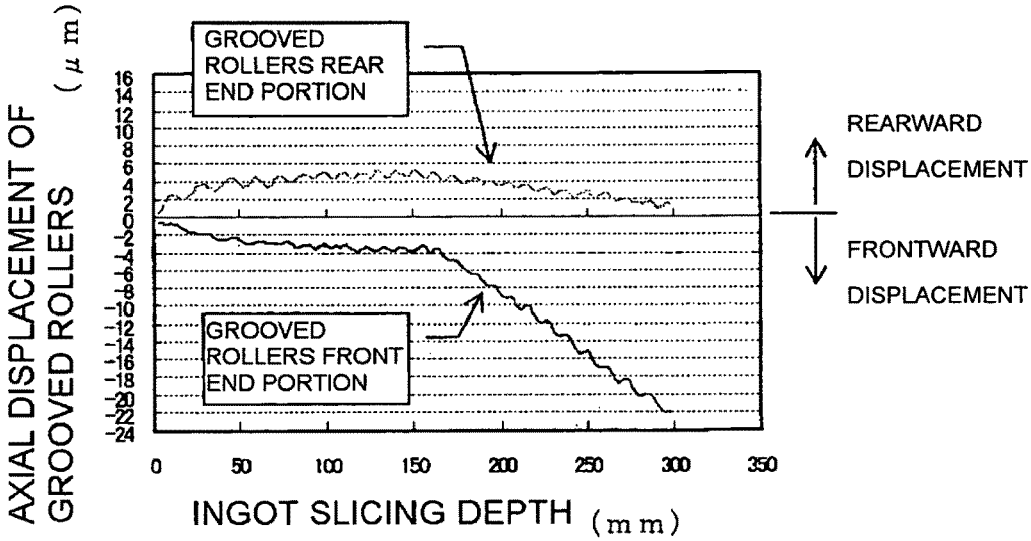
Figure 9:
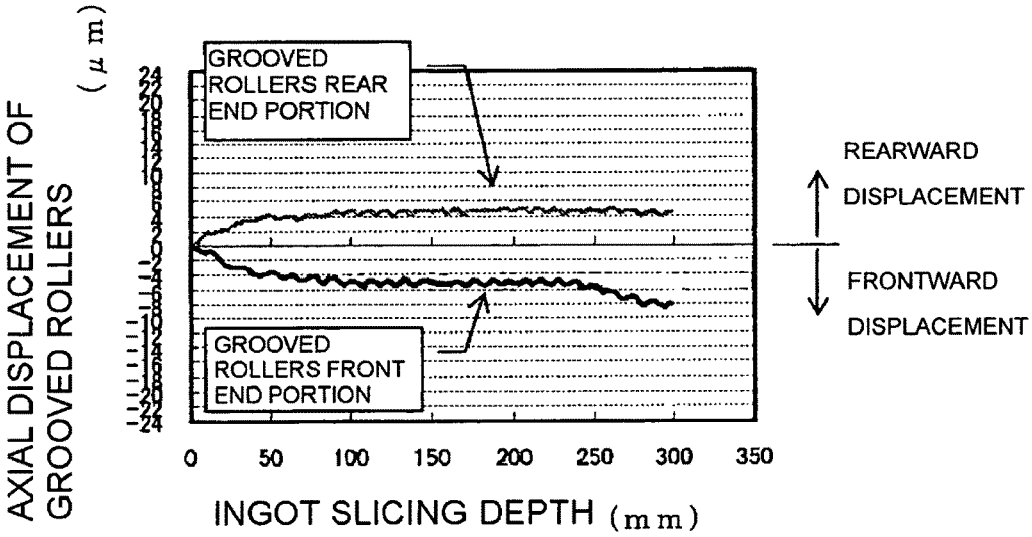

It is to be noted that an axial displacement of the grooved rollers was measured by the eddy current sensors in the main-slicing process. FIG. 9 shows a relationship between an ingot slicing depth and an axial displacement of the grooved rollers as a result of this measurement.

It can be understood from FIG. 9 that a front end portion of the grooved rollers greatly expands frontward as shown in FIG. 8 from the slicing depth reaches approximately 150 mm since the supply temperature of the slurry for slicing is gradually increased when the slicing depth reaches ½ of a diameter (a slicing depth of 150 mm). Furthermore, a rear end portion of the same also slightly expands frontward from the slicing depth reaches approximately 150 mm.

That is, since the grooved rollers that demonstrate such an expansion change are used to perform slicing, a curve of each slicing trajectory becomes convex direction rearward at each position from the front end portion to the rear end portion of the ingot.

Figure 10:
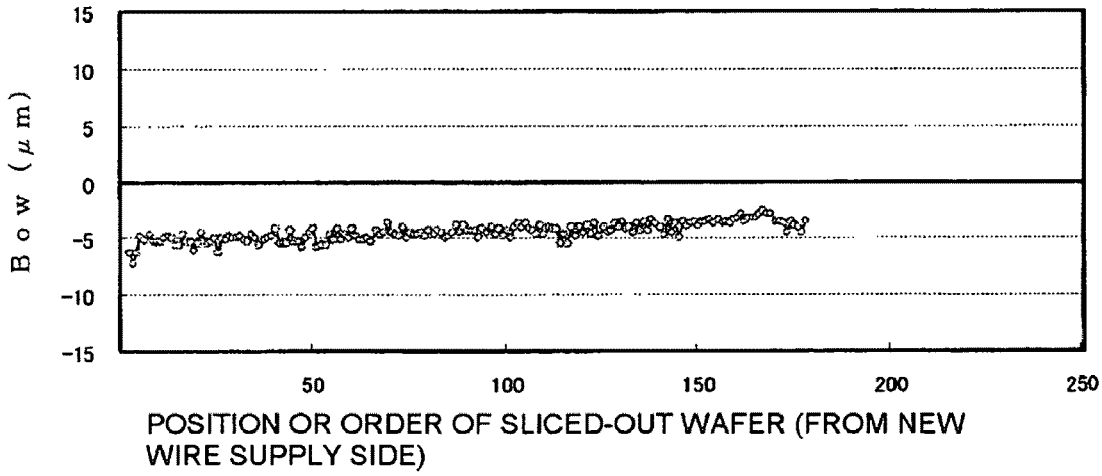
Figure 10:
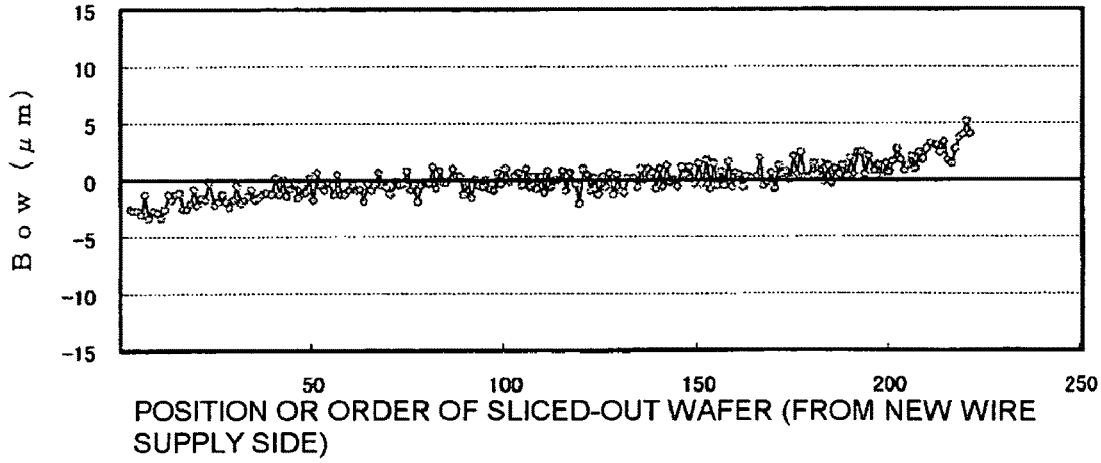

FIG. 10(A) shows a Bow measurement result obtained by actually measuring shapes of all wafers sliced out in above Example. As shown in FIG. 10(A), it can be understood that Bows of all sliced wafers fall within the range of approximately −3 μm to −6 μm and Sori are uniformed in one direction indicating negative Bow values.

Therefore, when subjecting the wafers having Sori uniformed in one direction to epitaxial growth, it is not necessary to turn over wafers having an opposite Sori direction to uniform their direction like a later-explained. Comparative Example, polishing was able to be performed without changing the direction, and an epitaxial layer was able to be deposited on each of the wafers. It is to be noted that each Bow was measured to confirm each Sori direction in this example, but the Sori directions of the sliced wafers are uniformed in one direction when the slicing method according to the present invention is adopted, and hence such Bow measurement can be of course eliminated.

Moreover, Bows fall within the range of approximately −3 μm to −6 μm and have small fluctuations only, whereby Sori after obtaining each epitaxial wafer has a desired small value and rarely fluctuates.

(Comparative Example)

The wire saw used in Example was adopted, and the same silicon ingot as that in Example was sliced into wafers. It is to be noted that, as different from Example, a preliminary test was not conducted and a supply temperature of a slurry for slicing had a supply temperature profile close to a room temperature like the conventional example as shown in FIG. 8.

It is to be noted that other slicing conditions were the same as those in Example.

As shown in FIG. 9(B), in regard to an axial displacement of a grooved rollers, a rear end portion of the grooved rollers expanded rearward approximately 4 μm and became substantially constant from a slicing depth reached approximately 50 mm to 100 mm, and a front end portion of the same expanded approximately 4 μm and became substantially constant and then slightly expanded frontward when the slicing depth reached 250 mm to 300 mm at the moment close to end of slicing and then became 8 μm.

As a result, as shown in FIG. 10(B), roughly classifying Sori directions of sliced wafers, Sori directions at a front end portion of the ingot have negative values and Sori directions at a rear end portion of the ingot have positive values. Moreover, negative and positive Bow values are intensively switched in a central region of the ingot in the axial direction, and it can be understood that the Sori directions are not uniformed at all. As explained above, this situation is relatively apt to occur when, e.g., a change in axial displacement amount is small at each position of the grooved rollers in the axial direction throughout the entire slicing process.

Therefore, when performing epitaxial growth, like the conventional example, Bow measurement is performed with respect to all wafers, each wafer having a Bow in an opposite direction was turned over to align its Sori direction, and then an epitaxial layer was deposited. Therefore, a work efficiency was poor, and more effort and cost were required beyond necessity.

Additionally, even if the reversing operation is carried out, an absolute value of Bows fluctuates in the range of 0 to 5, and obtaining desired Sori of each wafer after epitaxial growth is difficult.

It is to be noted that the present invention is not restricted to the foregoing embodiment. The foregoing embodiment is just an exemplification, and any examples that have substantially the same structure and demonstrate the same functions and effects as those in the technical concept described in claims of the present invention are included in the technical scope of the present invention.

The invention claimed is:

1. A slicing method comprising:

winding a wire around a plurality of grooved rollers, pressing the wire against an ingot to be sliced into wafers while supplying a slurry for slicing to the grooved rollers and causing the wire to travel, wherein a test of slicing the ingot while supplying the slurry to the grooved rollers and controlling a supply temperature thereof is previously conducted to examine a relationship between an axial displacement of the grooved rollers and a supply temperature of the slurry, a supply temperature profile of the slurry is set based on the relationship between an axial displacement of the grooved rollers and a supply temperature of the slurry, and the slurry is supplied based on the supply temperature profile such that the ingot is sliced while controlling an axial displacement of the grooved rollers, and the resultant wafers of the ingot are bowed in a uniform direction.

2. The slicing method according to claim 1, wherein the supply temperature profile of the slurry is adjusted to adjust amounts of bow of all the wafers to be sliced.

3. The slicing method according to claim 1, wherein the supply temperature profile of the slurry is set such that the supply temperature is gradually increased after a slicing depth of the ingot reaches at least ½of a diameter.

4. The slicing method according to claim 2, wherein the supply temperature profile of the slurry is set such that the supply temperature is gradually increased after a slicing depth of the ingot reaches at least ½of a diameter.

5. The slicing method according to claim 1, wherein the supply temperature profile of the slurry is set such that the supply temperature is gradually increased from start of slicing the ingot.

6. The slicing method according to claim 2, wherein the supply temperature profile of the slurry is set such that the supply temperature is gradually increased from start of slicing the ingot.

7. A method for manufacturing an epitaxial wafer, wherein wafers that bow uniformly in one direction are sliced out by the slicing method according to claim 1, and an epitaxial layer is deposited on the wafers that bow uniformly in one direction.

8. A method for manufacturing an epitaxial wafer, wherein wafers that bow uniformly in one direction are sliced out by the slicing method according to claim 2, and an epitaxial layer is deposited on the wafers that bow uniformly in one direction.

9. A method for manufacturing an epitaxial wafer, wherein wafers that bow uniformly in one direction are sliced out by the slicing method according to claim 3, and an epitaxial layer is deposited on the wafers that bow uniformly in one direction.

10. A method for manufacturing an epitaxial wafer, wherein wafers that bow uniformly in one direction are sliced out by the slicing method according to claim 4, and an epitaxial layer is deposited on the wafers that bow uniformly in one direction.

11. A method for manufacturing an epitaxial wafer, wherein wafers that bow uniformly in one direction are sliced out by the slicing method according to claim 5, and an epitaxial layer is deposited on the wafers that bow uniformly in one direction.

12. A method for manufacturing an epitaxial wafer, wherein wafers that bow uniformly in one direction are sliced out by the slicing method according to claim 6, and an epitaxial layer is deposited on the wafers that bow uniformly in one direction.

* * * * *